United States Patent [19]

Smith

[11] 4,052,024

[45] Oct. 4, 1977

[54] PNEUMATIC GEAR MOTOR APPLICATION

[75] Inventor: James M. Smith, Fanibel Island, Fla.

[73] Assignee: The United States of America as represented by the Secretary of the Army, Washington, D.C.

[21] Appl. No.: 685,553

[22] Filed: May 12, 1976

[51] Int. Cl.[2] ..... F15C 3/12; F41G 7/00

[52] U.S. Cl. ..... 244/3.21; 222/3; 244/78; 418/206

[58] Field of Search ..... 244/3.21-3.29, 244/78; 418/206; 222/3

[56] References Cited

U.S. PATENT DOCUMENTS

| | | | |
|---|---|---|---|
| 3,154,015 | 10/1964 | Muller | 244/3.21 |
| 3,163,014 | 12/1964 | Wismar | 222/3 |
| 3,174,435 | 3/1965 | Sisson et al. | 418/206 |
| 3,260,271 | 7/1966 | Katz | 244/78 X |
| 3,610,267 | 10/1971 | Warren | 244/3.22 |

OTHER PUBLICATIONS

Fundamentals of Rockets, Missiles and Spacecraft, by Hobbs 1963, pp. 88, 89.

*Primary Examiner*—Harold Tudor
*Attorney, Agent, or Firm*—Nathan Edelberg; Robert P. Gibson; James T. Deaton

[57] ABSTRACT

A pneumatic gear motor application in which a tank filled to a predetermined pressure with an inert gas such as nitrogen is heated by a heat squib device to raise the temperature of the gas and also to increase the pressure of the gas in the storage tank and be supplied through a first frangible valve to a pressure regulator for regulating an outlet pressure to a servo valve for controlling flow to and from a pneumatic motor. The pneumatic motor drives through a reduction gear mechanism that drives a worm and worm gear to actuate a control fin of a missile. The missile has four drive motors and four control fins to provide guidance for the missile.

6 Claims, 8 Drawing Figures

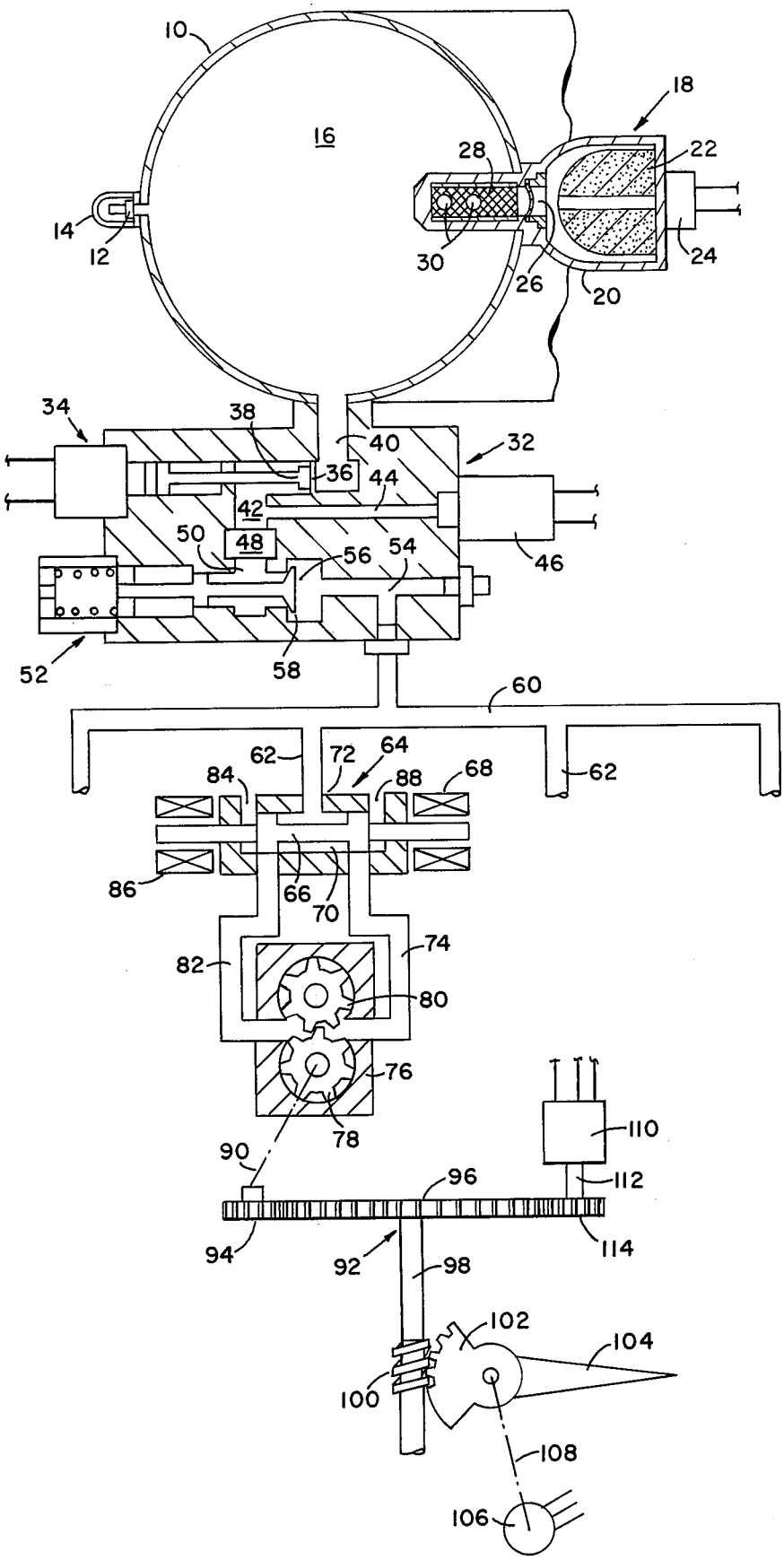
10
16
18
22
28
14
12
30
26
24
20
34
38
40
32
36
44
42
50
48
56
54
46
52
58
60
62
72
64
84
88
68
62
86
66
70
74
82
80
76
78
110
90
96
112
94
92
114
98
102
104
100
108
106

PNEUMATIC GEAR MOTOR APPLICATION

DEDICATORY CLAUSE

The invention described herein was made under contract with the Government and may be manufactured, used, and licensed by or for the Government for governmental purposes without the payment to me of any royalties thereon.

CROSS REFERENCE TO RELATED APPLICATION

This application is related to applicant's copending application Ser. No. 685,552 filed May 12, 1976.

BACKGROUND OF THE INVENTION

In the past, various hydraulic or electro-mechanical systems have been developed for control fins, however these systems have not provided the high performance required in some applications. Therefore, it is an object of this invention to provide a lightweight pneumatic system that can be used to drive a pneumatic motor that in turn drives through appropriate gear mechanism to actuate control fins to thereby cause the system to have high performance as a result of the pneumatic motor application.

Another object of this invention is to provide a pneumatic system that can achieve good stiffness characteristics, band width, natural frequency, and low gas consumption for the amount of work accomplished.

A further object of this invention is to eliminate hysteresis in systems of this type.

Still another object of this invention is to provide a system in which the system's shelf and/or operating life is increased.

A still further object of this invention is to utilize a motor that eliminates dynamic seals and sliding parts in order to yield high performance.

Other objects and advantages of this invention will be obvious to those skilled in this art.

SUMMARY OF THE INVENTION

In accordance with this invention, a pneumatic gear motor application is provided that includes a toroidal shaped tank that is filled with an inert gas to a predetermined pressure with a gas generator mounted on the toroidal shaped tank to further pressurize the inert gas within the toroidal shaped tank at the appropriate time and control means mounted on the tank for controlling the supply of inert gas to a pneumatic motor or a plurality of pneumatic motors. The control means includes a frangible valve that is actuated to open a fluid passage for the inert gas from the toroidal shaped tank to a sensor for sensing a predetermined pressure and to a filter for passing the inert gas to a pressure regulator for supplying the inert gas at a predetermined pressure to a manifold which distributes the inert gas to a plurality of pneumatic motors through two-way servo valves that control the supplying and exhausting of the inert gas to the pneumatic motors. Such pneumatic motor is connected through reduction gearing to a worn which drives a worm wheel, and the worm wheel in turn is connected to a control surface on a missile to provide guidance of the missile. The reduction gearing has a velocity feedback generator connected there-to and the control surface has a control surface position feedback generator connected thereto for feeding signals back to a central control for the overall system.

BRIEF DESCRIPTION OF THE DRAWING

In the drawing:

The single FIGURE of the drawing is a schematic view partially in section of a pneumatic gear motor application in accordance with this invention.

DESCRIPTION OF THE PREFERRED EMBODIMENT

Referring now to the drawing, a pneumatic gear motor application according to this invention is illustrated and includes a toroidal shaped tank 10 that has filling means at 12 with a cover 14 that is ultimately welded to the tank to seal nitrogen gas 16 within tank 10. Heat squib 18 is mounted on tank 10 and includes housing 20 with propellant 22 mounted therein to be ignited by a conventional igniter 24. Rupture diaphragm 26 seals the nitrogen gas contained in tank 10 from the solid propellant within housing 20. A filter 28 filters the gases from ignition of solid propellant 22 and the gas created by the burning of solid propellant 22 is communicated through filter 28 and outlets 30 into tank 10 at the appropriate time.

Control housing 32 contains a fluid passage therethrough that is initially sealed by a conventonal piston actated explosive valve 34. A partition 36 is ruptured by member 38 when explosive valve 34 is actuated to communicate the nitrogen gas from inlet passage 40 to outlet passage 42. Outlet passage 42 communicates with passage 44 and go/no go pressure switch 46 is used to provide a signal to a launch circuit for a missile. Pressure switch 46 has the signal thereof utilized to preclude firing of a missile when insufficient gas pressure exists at outlet 42.

Filter 48 is mounted between outlet 42 and inlet 50 to pressure regulator 52 to filter out any impurities that may exist in the inert gas such as nitrogen that is being supplied to conventional pressure regulator 52. Pressure regulator 52 is one that is designed to reduce the pressure from inlet 50 to outlet 54 of a pressure at the outlet of 400 psi. This is accomplished by coaction of valve head 56 of pressure regulator 52 with valve seat 58. The outlet pressure of 400 psi is communicated from outlet 54 to manifold 60 which dispenses the inert gas by way of inlet passage 62 to a plurality (preferably four) of servo actuators 64 (only one of which is shown). For further details of the storage tank and control actuation, see applicant's copending application Ser. No. 685,552 filed May 12, 1976.

Each servo actuator 64 has a spool valve 66 that is normally biased in a neutral position as illustrated and is actuated by solenoid 68 to cause gas to be supplied from inlet 62, chamber 70 formed by housing 72 around spool 66 and into passage 74 to pneumatic motor 76 to drive gears 78, 80 of the drive motor. At the same time gas is supplied through passage 74 to pneumatic motor 76, used gas is exhausted through passage 82 and port 84 to the atmosphere. When pneumatic motor 76 is to be driven in the opposite direction, solenoid 86 is actuated to cause inlet 62 to be connected to chamber 70 and passage 82 to drive gears 78, 80 in the opposite direction. When driven in this direction, gas is exhausted through passage 74 and port 88 to the atmosphere.

Pneumatic gear type motor 76 used in this invention has several inherent features making it attractive for this system. Primarily, it has high torgue to inertia ratio allowing it to produce rapid acceleration and deceleration of the system. It lends itself to a design wherein a minimum volume of air is trapped between the valve and motor which results in a stiff air-spring allowing better response. The internal leakage of the motor is inherently low due to the natural labyrinth formed by the gear teeth and the easily controlled diametral and end clearances. No dynamic seals are needed which might deteriorate or leak. There is very low friction and no "striction" because of the absence of rubbing seal surfaces. Leakage and friction are constant and predictable allowing elimination of over-design to compensate for variations in these parameters. There is no variation in friction, leakage, or trapped volume with motor shaft position as in vane motor or linear actuator.

Gear 78 of pneumatic motor 76 is connected by shaft 90 to reduction gearing 92 that includes spur gear 94 that meshes with spur gear 96 to drive shaft 98 that is connected to worm 100 for driving worm gear 102. Worm gear 102 is connected to control fin 104 for actuation thereof. A position feedback potentiometer 106 is connected to shaft 108 for movement as control fin 104 is moved to feedback a signal to the control center (not shown) for indicating the position of control fin 104. A velocity transducer or generator 110 is connected by shaft 112 to spur gear 114 which meshes with spur gear 96. Velocity transducer 110 produces a signal that is utilized in the control center for velocity indication at the overall control center of the system.

Reduction gearing 92 has been found to work very acceptably with a reduction ratio of 150:1 of the combination spur and worm gear arrangement. The reduction between spur gears 94, 96 can be about 15 to 1 and the reduction between worm 100 and worm gear 102 can be about 10 to 1.

In operation, with tank 10 filled with the inert nitrogen gas 16, the system is ready for activation and an electrical signal from a launcher or control center (not shown) is sent to the actuator of explosive valve 34 and to igniter 24 of heat squib 18 simultaneously to further pressurize inert gas 16 and open the gas flow from passage 40 to passage 42. At the same time inert gas is supplied to passage 42, it is also supplied to passage 44 and to go/no go pressure switch 46 that is connected into the system to prevent the control or actuation of solenoids 68, 86 that control the gas supply to pneumatic motors 76. If the pressure at outlet 42 is sufficient, it passes through filter 48 and between valve head and seat 56 and 58 of pressure regulator 52 that supplies the regulated pressure at outlet 54 at about 400 psi to manifold 60 which supplies the inert gas to solenoid actuated servo valves 64, that supply and exhaust the inert gas from pneumatic motors 76 to drive shaft 90 and in turn spur gear 94, spur gear 96, shaft 98, worm 100, worm gear 102, and finally control fin 104. Also, as pneumatic motor 76 drives through reduction gearing 92, velocity transducer 110 is actuated by spur gear 114 and shaft 112 and position feedback potentiometer 106 is actuated to send signals to the control center to indicate the condition of the servo system. As can be seen, a system of the type disclosed herein is very rugged and reliable since all the parts can be located in central and compact structures that are close to each other. Also, a system of this type is very efficient since the pneumatic motor requires no seals, but can be efficiently actuated to very high speeds with an inert gas.

I claim:

1. A pneumatic device comprising a source of pneumatic gas supply, means supplying said gas at a predetermined pressure to a manifold, servo valve means connected to said manifold for receiving said gas at said predetermined pressure and connected to a pneumatic gear motor for supplying and exhausting said gas to and from said pneumatic gear motor, a gear of said pneumatic gear motor being connected to reduction gearing that is driven by said pneumatic gear motor, and said reduction gearing being connected for driving a control fin and a position feedback potentiometer to indicate the position of the control fin.

2. A pneumatic device as set forth in claim 1, wherein said reduction gearing is spur gears connected at said pneumatic gear motor and a worm and worm gear connected at said control fin for driving said control fin and said feedback potentiometer.

3. A pneumatic device as set forth in claim 1, wherein said reduction gearing has a reduction ratio of about 150:1 and a velocity transducer is connected to one of said spur gears for indicating velocity.

4. A pneumatic device as set forth in claim 3, wherein said spur gears have a reduction ratio of about 15:1 and said worm and worm gear have a reduction ratio of about 10:1.

5. A pneumatic device as set forth in claim 4, wherein said means supplying said gas at a predetermined pressure is a tank containing said gas supply, a valve interconnecting said tank to a pressure regulator, and said pressure regulator delivering said gas at a regulated pressure to said manifold.

6. A pneumatic device as set forth in claim 5, wherein said tank has means mounted thereon for raising the pressure and temperature of the gas within said tank.

* * * * *